US008808461B2

(12) United States Patent
Karjunen

(10) Patent No.: US 8,808,461 B2
(45) Date of Patent: Aug. 19, 2014

(54) METHOD AND DEVICE FOR EMPTYING THE FLOOR OF A BLACK LIQUOR RECOVERY BOILER

(75) Inventor: Timo Karjunen, Vantaa (FI)

(73) Assignee: BOILDEC Oy, Vantaa (FI)

( * ) Notice: Subject to any disclaimer, the term of this patent is extended or adjusted under 35 U.S.C. 154(b) by 471 days.

(21) Appl. No.: 13/132,947

(22) PCT Filed: Oct. 19, 2009

(86) PCT No.: PCT/FI2009/050836

§ 371 (c)(1),
(2), (4) Date: Jun. 6, 2011

(87) PCT Pub. No.: WO2010/063875

PCT Pub. Date: Jun. 10, 2010

(65) Prior Publication Data

US 2011/0232688 A1 Sep. 29, 2011

(30) Foreign Application Priority Data

Dec. 5, 2008 (FI) ..... 20086166

(51) Int. Cl.
*F27D 3/14* (2006.01)
*D21C 11/12* (2006.01)
*F04F 5/54* (2006.01)

(52) U.S. Cl.
CPC ... *F02F 5/24* (2013.01); *F27D 3/14* (2013.01); *D21C 11/12* (2013.01); *F04F 5/54* (2013.01)
USPC ..... 134/21; 134/22.1; 134/105; 134/22.18; 162/30.1; 162/239; 15/104.05; 110/238; 110/259

(58) Field of Classification Search
CPC ..... F27D 3/14; D21C 11/12; D21C 11/122; F23J 9/00
USPC ..... 134/21, 22.1, 105; 162/17, 48, 52, 199, 162/239, 240, 246, 272, 29, 30.1, 30.11, 162/31–39; 15/104.05; 159/43.1; 202/241, 202/261; 110/238, 259
See application file for complete search history.

(56) References Cited

U.S. PATENT DOCUMENTS 124,700 A 3/1872 Sellers
461,429 A 10/1891 Frasch
(Continued)

FOREIGN PATENT DOCUMENTS

CA 1078559 A1 6/1980
CN 1688342 A 10/2005
(Continued)

OTHER PUBLICATIONS

Friatec AG, Division Rheinhutte Pumpen, Pumps for moving molten salts; Wiesbaden, Germany.

(Continued)

*Primary Examiner* — Michael Kornakov
*Assistant Examiner* — Katelyn Whatley
(74) *Attorney, Agent, or Firm* — Ziegler IP Law Group, LLC

(57) ABSTRACT

A method for emptying a furnace floor from smelt in a black liquor recovery boiler when the black liquor recovery boiler is being shut down. The emptying can be started while smelt is still flowing in smelt spouts. The floor is emptied by sucking smelt from the furnace with a smelt eductor. A device for removing smelt and wash water from a furnace of a black liquor recovery boiler by means of suction. Negative pressure is generated in the device by conducting pressurized gas into a suction pipe of an eductor so that preheated pressurized gas is discharged in the discharge direction of smelt and wash water.

4 Claims, 4 Drawing Sheets

(56) References Cited

U.S. PATENT DOCUMENTS

| | | | | | |
|---|---|---|---|---|---|
| 1,670,156 | A | | 5/1928 | Howell | |
| 1,866,682 | A | | 7/1932 | Temmen | |
| 2,030,560 | A | | 2/1936 | Adams | |
| 2,091,829 | A | | 8/1937 | Nelson | |
| 2,137,619 | A | | 11/1938 | Lee | |
| 2,210,544 | A | | 8/1940 | Galloway | |
| 2,948,524 | A | | 8/1960 | Sweeney et al. | |
| 3,211,545 | A | | 10/1965 | Sickbert | |
| 3,291,473 | A | | 12/1966 | Sweeney et al. | |
| 3,440,026 | A | | 4/1969 | Dubow | |
| 3,630,573 | A | | 12/1971 | Goddin et al. | |
| 3,632,096 | A | | 1/1972 | Perry | |
| 3,667,879 | A | | 6/1972 | Cerpelli | |
| 3,776,660 | A | | 12/1973 | Anderson et al. | |
| 3,867,132 | A | | 2/1975 | Perry | |
| 3,934,523 | A | * | 1/1976 | Bercynski et al. | 110/165 R |
| 4,011,047 | A | * | 3/1977 | Tremblay | 422/185 |
| 4,105,438 | A | | 8/1978 | Sherwood | |
| 4,249,775 | A | | 2/1981 | Zakiewicz | |
| 4,456,476 | A | | 6/1984 | Sherwood | |
| 4,462,319 | A | | 7/1984 | Larsen | |
| 4,628,828 | A | | 12/1986 | Holtham et al. | |
| 4,750,649 | A | | 6/1988 | Fahey et al. | |
| 4,808,264 | A | | 2/1989 | Kignell | |
| 4,869,555 | A | | 9/1989 | Peters et al. | |
| 4,878,441 | A | * | 11/1989 | Ryham | 110/238 |
| 4,938,276 | A | | 7/1990 | Noguchi et al. | |
| 5,121,869 | A | | 6/1992 | Knudsen et al. | |
| 5,203,681 | A | | 4/1993 | Cooper | |
| 5,305,990 | A | | 4/1994 | Sherwood | |
| 5,355,844 | A | | 10/1994 | Kendrick | |
| 5,437,768 | A | * | 8/1995 | Smith et al. | 162/239 |
| 5,441,390 | A | | 8/1995 | Rapp et al. | |
| 5,478,440 | A | * | 12/1995 | Paju | 162/30.1 |
| 5,509,791 | A | | 4/1996 | Turner | |
| 5,635,095 | A | | 6/1997 | Kleinfeld | |
| 5,667,201 | A | * | 9/1997 | Beveridge et al. | 266/196 |
| 5,800,773 | A | * | 9/1998 | Beveridge et al. | 266/236 |
| 5,976,319 | A | * | 11/1999 | Paju et al. | 162/30.1 |
| 6,287,415 | B1 | | 9/2001 | Salmi et al. | |
| 6,311,630 | B1 | * | 11/2001 | Vanhatalo | 110/342 |

FOREIGN PATENT DOCUMENTS

| | | | | | |
|---|---|---|---|---|---|
| DE | 605701 | | * | 11/1934 | |
| DE | 195 41 093 | A1 | | 5/1997 | |
| GB | 848572 | A | | 9/1960 | |
| GB | 1390636 | A | | 4/1975 | |
| GB | 2337085 | A | | 11/1999 | |
| JP | 60050380 | A | | 3/1985 | |
| JP | 61-070200 | A | | 4/1986 | |
| JP | 62047468 | A | | 3/1987 | |
| JP | 2001-199389 | A | | 7/2001 | |
| JP | 2001-524620 | A | | 12/2001 | |
| RU | 13066 | U1 | | 3/2000 | |
| RU | 2315905 | C1 | | 1/2008 | |
| RU | 2335396 | C2 | | 10/2008 | |
| WO | 99/27180 | A1 | | 6/1999 | |
| WO | 2004016288 | A1 | | 2/2004 | |
| WO | 2008/046959 | A1 | | 4/2008 | |
| WO | WO 2008046959 | A1 | * | 4/2008 | F27D 3/14 |

OTHER PUBLICATIONS

Ryti, Henrik; Mechanics, Part 1, Static Machines 379, 1976, Otapalno, Espooo, Finland; pp. 361-367.

Suomen Standardisoimisliitto Finlands Standardiseringsforbund; SFS 4874; Classification and function principles of pumps used for the transfer of liquids; Vahvistettu, Dec. 31, 1982, pp. 1-10.

Chinese Office Action, Application No. 200980148580.6, dated Jun. 8, 2013.

English language translation of Chinese Office Action, Application No. 200980148580.6, dated Jun. 8, 2013.

Recovery Boiler Training Course, The Employers' Federation of Swedish Forest Industries, 1982.

Ballast Eductors, Schutte & Koerting, Reprinted with permission of Seamanship International Ltd., Exerpted from Chemical Tanker Notes, Published 2006.

R. Rayner, Pump Users Handbook, 4th Edition, Elsevier Advanced Technology, Oxford, UK, 1995, p. 24.

English Translation of Russian Office Action, Application No. 2011 126 272/12, dated Oct. 21, 2013.

* cited by examiner

METHOD AND DEVICE FOR EMPTYING THE FLOOR OF A BLACK LIQUOR RECOVERY BOILER

CROSS-REFERENCE TO RELATED APPLICATIONS

This application is the US National Stage of International Application No. PCT/FI2009/050836, having an international filing date of Oct. 19, 2009, which designated the United States of America and which was published under PCT Article 21 (2) as Publication No. WO2010/063875 A1 on Jun. 10, 2010, and which claims priority to Finnish Application No. 20086166, filed Dec. 5, 2008, the disclosure of which is incorporated herein by reference in its entirety.

BACKGROUND

1. Field

The aspects of the disclosed embodiments relate to the emptying of the floor of a black liquor recovery boiler, in particular, but not solely, to the emptying of smelt and/or wash water from the black liquor recovery boiler when the boiler is being shut down.

2. Brief Description of Related Developments

A black liquor recovery boiler is used for combusting black liquor generated in connection with pulp manufacture, containing various sodium salts besides organic matter and water. During the operation of the boiler, these salts form a smelt pool on the furnace floor, from which smelt continuously flows through smelt spouts to a dissolving tank. The smelt spouts are typically located approximately 250 mm above the level of the furnace floor. Typically, there is continuously a smelt layer of at least approximately 300 mm on the furnace floor during operation.

When the black liquor boiler is shut down for maintenance, for example, the furnace floor remains covered with smelt. When the floor cools down, the smelt solidifies and forms a hard "cake", which must be removed by water washing or by chiseling if the aim is to clean the floor for maintenance work or inspections. The cleaning of the floor significantly extends the shutdown period, so a method and apparatus for removing smelt from the furnace by pumping have been devised in order to save time, as disclosed in the Finnish patent application no. 974206. The pumping is started in a situation where the surface of the smelt has reached the level of the lower edge of the smelt spout opening when the boiler is being shut down. Heating of the smelt is continued with a gas or oil flame and a spiral pump is used for the pumping.

When using a spiral pump, the smelt is pumped from the furnace floor using a rectilinear pipe having a pipe mouth at one end and a pump drive at the other end. There is a curved portion around the middle of the pipe, forming a discharge pipe through which the smelt is discharged from the pipe. In black liquor recovery boilers where the floor profile is such that the smelt pool is at its deepest close to the smelt spouts, it may not be possible to pump smelt from the deepest location of the pool with a spiral pump; rather, a considerable amount of smelt may, in many cases, remain on the furnace floor after the pumping. This extends the time needed for water washing and thus slows down the shutting down of the boiler. Another problem associated with the use of spiral pumps is that their installation requires a fairly long period of work in the immediate vicinity of the smelt spouts.

The Finnish patent application no. 20065668 discloses a method and device for emptying the floor of a black liquor recovery boiler of smelt when the boiler is being shut down.

The floor is emptied by sucking smelt from the furnace with a smelt eductor. Negative pressure is generated in the device by conducting pressurized gas into a suction pipe of the eductor so that the pressurized gas is discharged in the discharge direction of smelt.

SUMMARY

One aspect of the disclosed embodiments provides a method and device that enable further increasing the efficiency of smelt sucking from a black liquor recovery boiler.

In accordance with one embodiment of the disclosure, there is provided a method for emptying the floor of a black liquor recovery boiler when the boiler is being shut down, the method comprising generating negative pressure suction with a suction device by arranging the discharge of a pressure medium from an outlet within the suction device in the discharge direction of the suction device, and sucking smelt from the black liquor recovery boiler with the suction device through an opening in a wall of the black liquor recovery boiler by negative pressure suction, and the method comprising preheating the pressure medium before it is discharged from the outlet.

In certain embodiments of the disclosure, smelt is sucked using a suction device from a black liquor recovery boiler through an opening in a wall of the black liquor recovery boiler by means of negative pressure suction generated using a pressure medium supplied through a pressure medium pipe, and preheating the pressure medium before it is discharged from a discharge end of the pressure medium pipe, positioned within the suction device.

In certain embodiments of the disclosure, the negative pressure required for the suction device is generated by conducting a pressure medium, such as pressurized gas or pressurized steam, into the suction device so that the gas is discharged in the discharge direction of the suction device.

In certain embodiments of the disclosure, a pressure medium is heated with the aid of hot smelt. In certain embodiments of the disclosure, a pressure medium is heated with hot smelt and/or with a separate heat source independent of the smelt before an inlet into a suction pipe. Thus, in certain embodiments of the disclosure, a pressure medium is heated with hot smelt and/or a separate heat source independent of the smelt while the pressure medium flows in a pressure medium pipe or a pressure medium channel outside the suction pipe of the suction device. In certain embodiments, a pressure medium is heated using hot smelt while the pressure medium flows in a pressure medium pipe within the suction pipe of the suction device.

In certain embodiments of the disclosure, a pressure medium is heated using a separate heat source independent of smelt, such as an electric resistor.

In accordance with a second embodiment of the disclosure, there is provided a suction device for emptying the floor of a black liquor recovery boiler, comprising an arrangement for generating, with the aid of a pressure medium, negative pressure suction with which smelt is sucked from the black liquor recovery boiler, and the suction device further comprises a preheating arrangement for heating the pressure medium.

In certain embodiments of the disclosure, the suction device comprises a pressure medium pipe the discharge end of which is within the suction pipe comprised by the suction device, and the preheating arrangement comprises preheating of the pressure medium before the discharge end.

In certain embodiments of the disclosure, the suction device comprises a pressure medium pipe that conforms to the form of the suction pipe comprised by the suction device.

In certain embodiments of the disclosure, the suction device comprises a pressure medium pipe that is positioned to travel within a suction pipe comprised by the suction device.

In certain embodiments of the disclosure, the suction device comprises a pressure medium pipe that is positioned to travel along an outer surface of the suction pipe comprised by the suction device.

In certain embodiments of the disclosure, the suction device comprises a separate pressure medium heating device, such as a heating resistor.

In certain embodiments of the disclosure, a heating resistor is adapted to heat the pressure medium pipe. Preferably, the heating resistor surrounds the pressure medium pipe.

In certain embodiments of the disclosure, the preheating arrangement comprises a pressure medium pipe positioned in a smelt eductor within the scope of the heating impact of hot smelt during the use of the smelt eductor.

In certain embodiments of the disclosure, the suction device generates the negative pressure used for eduction, and smelt is sucked by means of negative pressure suction.

In certain embodiments of the disclosure, a smelt eductor used is, as such, a non-mechanical device. Suction is generated, e.g., by means of gas or steam discharged at high speed. In certain embodiments, gas or steam is conducted into a suction device and further conducted to flow within the suction device in the discharge direction of the suction device. In an embodiment, gas initially tends to pull surrounding gas with it due to friction and, soon after (when the smelt eductor actually starts operating), it pulls smelt from the black liquor recovery boiler.

In certain embodiments of the disclosure, smelt is sucked through an opening in a wall of the black liquor recovery boiler. In certain embodiments of the disclosure, said opening is a smelt spout opening or another opening arranged for the purpose of emptying.

In certain embodiments of the disclosure, smelt is sucked using a smelt eductor from the furnace of a black liquor recovery boiler into a smelt spout, either directly or through a spout into a smelt pool or dissolving tank or another collection system. The substance being sucked is preferably smelt. In certain embodiments, the substance may alternatively be wash water.

In certain embodiments of the disclosure, the start of the emptying of the floor is advanced so as to start when smelt still flows in the smelt spouts. If, at this time, there is still unmolten smelt in the corners of the furnace, for example, the melting of the smelt may simultaneously be continued by spraying black liquor to the furnace and adjusting the spraying of black liquor so that the sprays of black liquor are distributed evenly over the entire furnace floor.

In certain embodiments of the disclosure, the eduction of smelt is continued until the floor of the furnace is entirely free of smelt. In an embodiment of the disclosure, if the black liquor tank becomes empty before the smelt pool on the floor of the furnace has been emptied, heating of the floor is continued by solely using oil or gas burners. The start of eduction can be timed to start so early that the period during which the heating of the smelt relies solely on gas or oil burners is too short for the smelt to solidify before the floor is emptied.

In certain embodiments of the disclosure, the shutting down of the black liquor recovery boiler is accelerated by positioning and shaping the eductors so that smelt is sucked from the deepest area of the smelt pool, whereby the floor can be emptied more thoroughly. Consequently, the boiler cools down faster after the emptying of the floor, whereby the start of water washing the furnace and superheaters located in the upper part of the furnace can be advanced.

In certain embodiments of the disclosure, a suction device is provided for emptying the floor of a black liquor recovery boiler when the boiler is being shut down, which suction device is adapted to be installed in an opening arranged in the wall of the black liquor recovery boiler, and the suction device comprising:

a mechanism for generating suction for emptying smelt from the black liquor recovery boiler.

In certain embodiments of the disclosure, a smelt eductor is used as a suction device, comprising a suction pipe having a suction end and a discharge end, which suction pipe is arranged to suck smelt through the suction end from the furnace of a black liquor recovery boiler, and the discharge end is arranged to discharge smelt from the eductor.

In certain embodiments of the disclosure, the suction device is designed so that, when installed in place in an opening in the boiler, a suction end of a suction pipe is positioned in a deep location of a smelt pool close to the floor and a discharge end discharges smelt into a smelt spout or directly into a discharge tank. In certain embodiments, a suction device is designed so that it conforms to the form of a smelt spout of the black liquor recovery boiler.

In certain embodiments of the disclosure, at least one bend is arranged in a suction pipe of the suction device, the angle of which determines the positions of a suction end and a discharge end. Preferably, the part of the suction pipe between the suction end and the bend is designed so that the suction end reaches the desired location on the furnace floor. Advantageously, when the eductor is installed in an opening in a wall of the black liquor recovery boiler, this bent part of the suction pipe is also adapted to limit the movement of the eductor outwards from the furnace.

In certain embodiments of the disclosure, the suction device is configured to generate negative pressure suction so that a pressure medium is conducted into a pressure medium pipe comprised by the suction device so that the pressure medium is discharged preheated from a discharge end comprised by the pressure medium pipe in the discharge direction of the suction device.

In certain embodiments of the disclosure, the suction device is configured to generate negative pressure suction in a manner in which preheated pressurized gas is conducted into a pressure medium pipe so that the gas is discharged in the discharge direction of the suction device.

In certain embodiments of the disclosure, a smelt eductor is configured to generate negative pressure suction so that pressurized gas is conducted into the eductor from a pressurized gas connection comprised by the eductor so that the gas is discharged in the discharge direction of the eductor. The eductor may comprise a pressurized gas pipe fitted to the suction pipe by welding, for example, which pressurized gas pipe may be used as an installation arm, holding which the eductor can be pushed in place in an opening in the boiler wall.

In certain embodiments of the disclosure, the pressurized gas pipe is smaller in diameter than the suction pipe and welded to the suction pipe so that it extends within the suction pipe and points towards the discharge end.

Certain embodiments of the disclosure involve using a smelt eductor based on negative pressure suction that can be safely installed in place even while smelt flows in the smelt spouts and which is not susceptible to mechanical failures as there are no moving parts in the suction pipe of the device.

Various embodiments of the invention will be or have been described only in connection with one or several of the aspects of the disclosed embodiments. Persons skilled in the art understand that any aspect of the disclosed embodiments can be applied employing the same aspect and other aspects of the invention either alone or in combination with other embodiments.

BRIEF DESCRIPTION OF THE DRAWINGS

In the following, the aspects of the disclosed embodiments will be described by way of example with reference to the appended drawings, in which.

DETAILED DESCRIPTION

It should be noted that the figures shown are not entirely to scale, and primarily serve to illustrate the embodiments of the disclosure.

Figure 1:
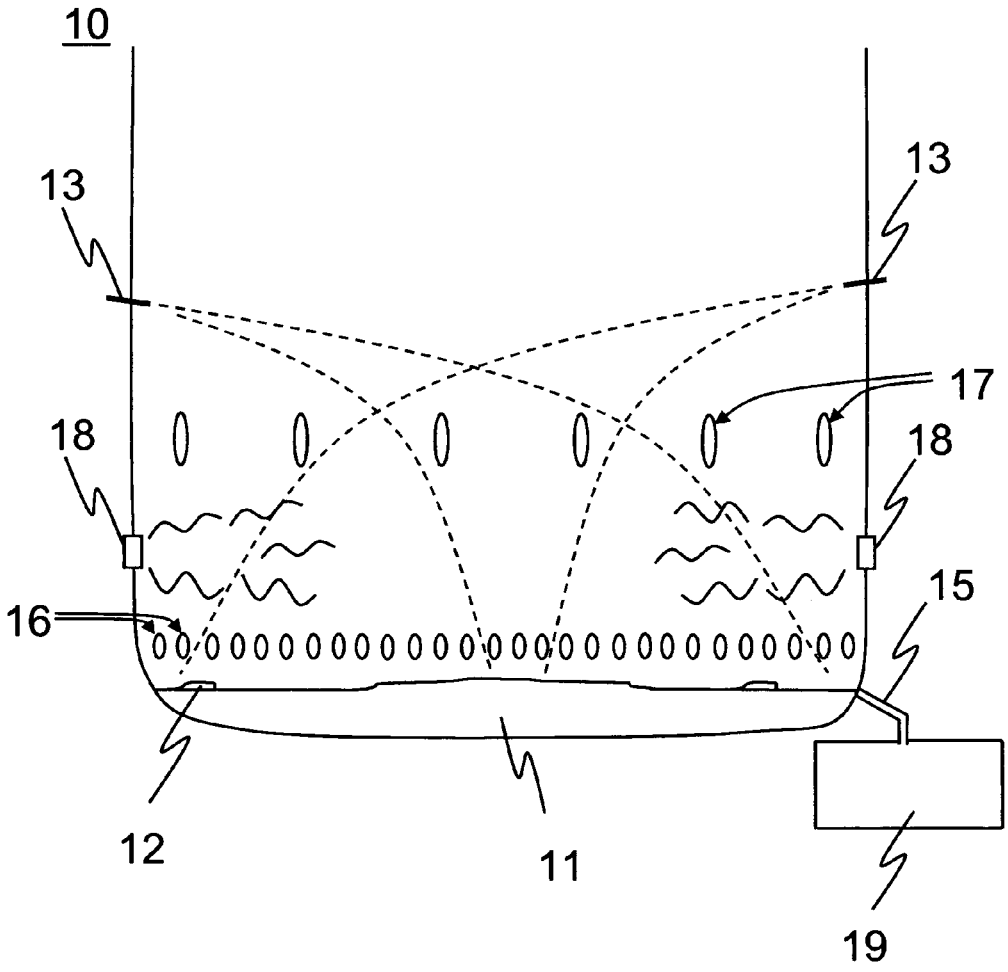
FIG. 1 shows a cross-section of a black liquor recovery boiler.

FIG. 1 shows a cross-section of a black liquor recovery boiler 10 in the area of a furnace of the black liquor recovery boiler. There is a pool of partly molten smelt 11 and a char bed and smelt deposits 12 on the floor of the boiler. Black liquor is sprayed into the boiler with black liquor spray nozzles 13, typically from openings in all four walls so that, when the boiler is fully loaded, there are typically 6 to 10 spray nozzles in use, depending on the size of the boiler. The black liquor spray openings are typically at a height of 6 to 7 meters from the floor. The combustion of the black liquor in the furnace of the boiler is controlled by conducting air into the boiler from primary air openings 16, secondary air openings 17 and tertiary air openings (not shown). The smelt forming on the floor flows from the smelt pool 11 through smelt spouts 15 to a dissolving tank 19.

In a method in accordance with an aspect of the disclosed embodiments, the aim is to first melt the smelt on the furnace floor in its entirety when the black liquor recovery boiler is being shut down by combusting black liquor and auxiliary fuel simultaneously, the auxiliary fuel commonly being oil or gas. The auxiliary fuel is combusted with start burners 18 installed on the walls of the boiler (FIG. 1).

The spraying of the black liquor is adjusted so that the black liquor sprays are distributed evenly over the entire furnace floor, whereby smelt deposits on the edges of the furnace can also be melted. The adjustment can be implemented, for example, by always using spray nozzles positioned at opposite sides of the boiler when the boiler is being shut down in order to provide symmetrical melting. One example case involves using two black liquor spray nozzles, whereby the valves of the black liquor line are kept open for black liquor spray nozzles on two opposite walls. Alternatively or additionally, the direction and pressure of the black liquor nozzles may be adjusted so that the black liquor is distributed over the entire floor and the black liquor forms droplets effectively. The selection and control mechanism for the black liquor spray nozzles to be used is, as such, known to persons skilled in the art.

In one embodiment, the combustion of the black liquor is adjusted while the boiler is being shut down by controlling the amount and distribution of combustion air so that a sufficient amount of primary air is conducted into the furnace compared with the flows of secondary and tertiary air as well as black liquor and auxiliary fuel so that the black liquor is mainly combusted in the lower part of the furnace. Thereby, the combustion of the black liquor heats the smelt on the floor more efficiently than gas flames, for example, the heat of which is more poorly conveyed to the floor. The control mechanism for the amount and distribution of combustion air is, as such, known to persons skilled in the art.

When the smelt on the floor is entirely or partly molten and a suitable amount of black liquor remains in the black liquor tank (not shown), the emptying of the floor is started by installing smelt eductors in the openings in the walls of the boiler and by opening valves of pressurized gas lines leading to the eductors. The flow of the black liquor is adjusted so that the smelt eductors remove a larger amount of smelt from the furnace floor than the amount of smelt carried to the furnace with the black liquor, whereby the smelt pool on the furnace floor begins to empty. This is continued until the black liquor tank is empty. After this, the heating of the floor is continued solely with the oil or gas burners 18 (FIG. 1).

The eduction of the smelt is continued until the floor is emptied of smelt so that the mouths of the suction ends of the eductors are partly revealed, at which point the suction is no longer sufficient to remove the smelt. After this, the smelt eductors may be removed for maintenance.

In certain embodiments, a smelt eductor is used for sucking the smelt, the smelt eductor using a pressure medium that is preheated before the discharge end of the pressurized gas pipe.

FIGS. 2 to 5 and 7 show examples of a smelt eductor suitable for smelt eduction in a partially sectional drawing. Negative pressure is generated in the eductor 20 by conducting a pressure medium, such as pressurized gas or steam, through a smaller pipeline 22 into the eductor. A pressure medium pipe, such as a pressurized gas line 22, is fastened to the eductor 20 so that the pressurized gas is discharged to the discharge side of the eductor, in the direction of smelt removal. Advantageously, the pressurized gas is discharged in the direction of the center line of the suction pipe 21 comprised by the eductor from the discharge end of the pressurized gas pipe 22. The pressurized gas pipe 22 and its discharge end functioning as an outlet may be positioned in the middle of the suction pipe or closer to its edge or so that it borders on the inner wall of the suction pipe.

Figure 2:
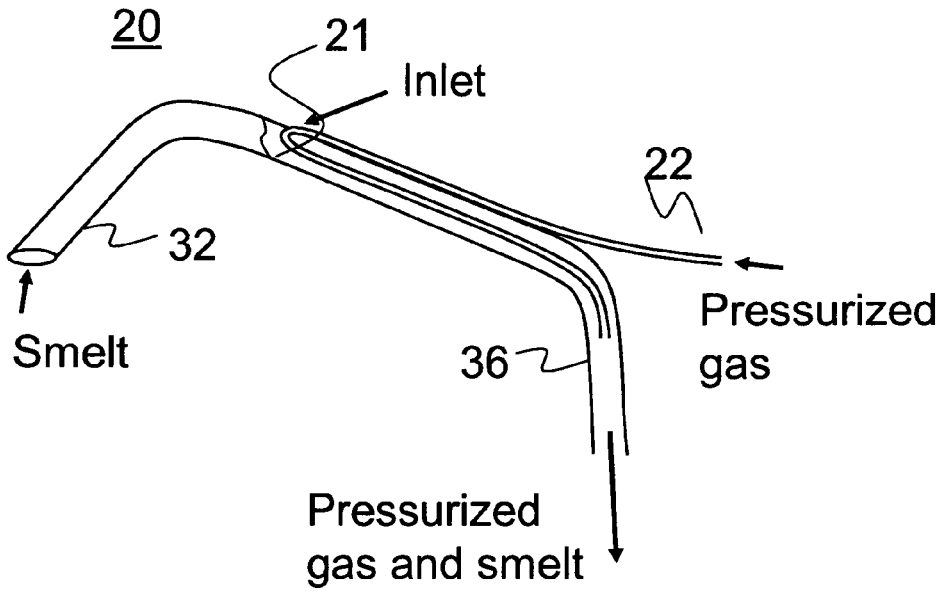
FIG. 2 shows a smelt eductor in accordance with an aspect of the disclosed embodiments.

As shown in FIG. 2, the eductor 20 comprises a suction pipe 21 and a pressurized gas pipe 22, which are made from acid-proof steel, for example. In an example case, the outer diameter of the suction pipe 21 is 76 mm and the thickness of the pipe wall is 3 mm. The outer diameter of the pressurized gas pipe 22 is 15 mm and the thickness of the pipe wall is 1 mm. In the example case shown in FIG. 2, the suction pipe 21 is welded from three rectilinear parts and two bends so that the lengths of the rectilinear parts are 300 mm, 750 mm and 250 mm, respectively, and the parts are joined by bends of 100° and 112°, respectively. The pressurized gas pipe 22 enters the suction pipe 21 through an opening drilled in a wall of the rectilinear middle part of the pipe, to which opening the pressurized gas pipe 22 is fastened by welding, for example. An inlet of the pressurized gas pipe 22 into the suction pipe 21 is leak-tight in order to generate a suitable negative pressure in the suction pipe 21 particularly at the initial phase of sucking. A discharge end 36 of the eductor is formed by a 250 mm long rectilinear pipe fastened to a 750 mm long rectilinear part using a bend of 112°. The pressurized gas pipe 22 is fastened within the suction pipe so that the pressurized gas pipe 22 conforms to the form of the suction pipe. Preferably, the pressurized gas pipe 22 is fastened within the suction pipe 21 to the 750 mm long rectilinear part of the suction pipe 21 and the rectilinear pipe forming the discharge end 36, aligned with the center lines of these pipes. The pressurized gas is thus discharged in the discharge direction of the eductor 20, thereby generating suction that removes the smelt or water from the furnace. In certain embodiments, the pressurized gas breaks down the smelt flow into droplets so that no separate breaking down with steam jets is necessarily needed.

In FIG. 2, the pressurized gas pipe 22 conforms to the form of the suction pipe 21 outside the suction pipe 21 before the pressurized gas pipe 22 enters into the suction pipe 21. Within the suction pipe, the pressurized gas pipe 22 conforms to the form of the suction pipe. As the pressurized gas pipe 22 is positioned in the eductor within the scope of the heating impact of hot smelt, the pressurized gas is heated outside and inside the suction pipe 21 before the pressurized gas is discharged into the suction pipe 21. Preferably, the pressurized gas pipe is fastened to the outer surface of the rectilinear middle part of the pipe.

Alternatively, the pressurized gas pipe 22 may be arranged to be outside the scope of the heating impact of smelt. In this case, the pressurized gas pipe may freely vary in form before the inlet and need not conform to the form of the suction pipe 21. This also applies to other embodiments.

Figure 3:
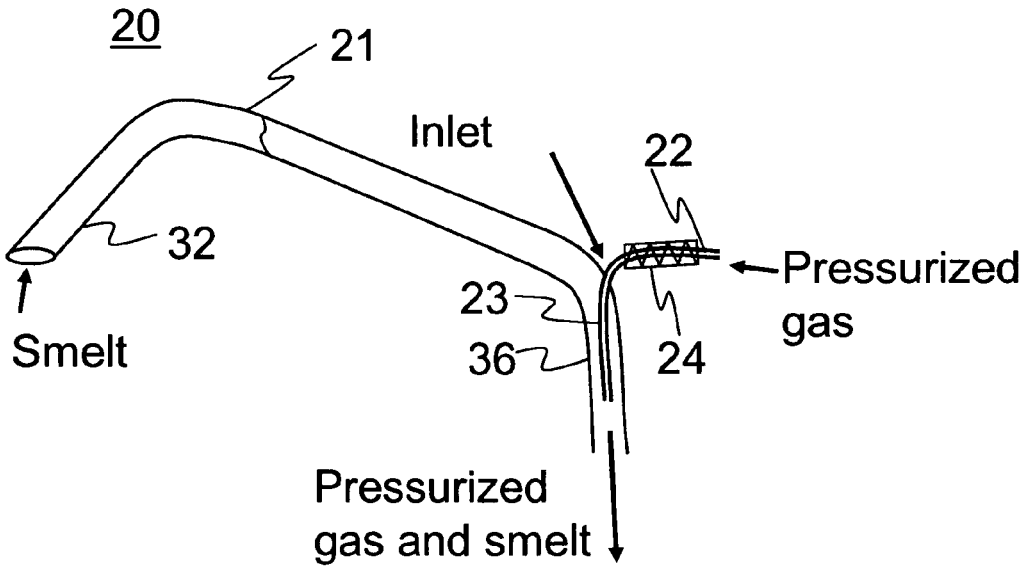
FIG. 3 shows a smelt eductor in accordance with an aspect of the disclosed embodiments.

FIG. 3 shows another example of a smelt eductor 20 suitable for educting smelt; as for its description, refer to FIG. 2, while noting that the positioning of the pressurized gas pipe is different and the pressurized gas is preheated by means of a separate heating device 24. If the pressurized gas pipe 22 is arranged to be very short after the inlet, preheating will, in practice, take place solely by means of the heating device 24. If the pressurized gas pipe 22 is arranged to travel into the suction pipe 21 over a longer distance, the pressurized gas pipe conforms to the form of the suction pipe and the heating of the pressurized gas is more effective. The heating device 24 is described in more detail below. The pressurized gas pipe 22 enters into the suction pipe 21 through an opening drilled into a wall of a bend preceding the discharge end 36, to which opening the pressurized gas pipe 22 is fastened by welding, for example. The inlet of the pressurized gas pipe 22 into the suction pipe 21 is implemented leak-tightly by welding, for example, so that a suitable negative pressure is generated in the suction pipe 21, particularly at the initial phase of sucking. Preferably, the pressurized gas pipe 22 is fastened to a rectilinear pipe forming the discharge end 36 within the suction pipe 21, aligned with the center line of the discharge end 36, whereby the pressurized gas is discharged in the discharge direction of the eductor 20, generating suction that pulls smelt or water from the furnace.

Figure 4:
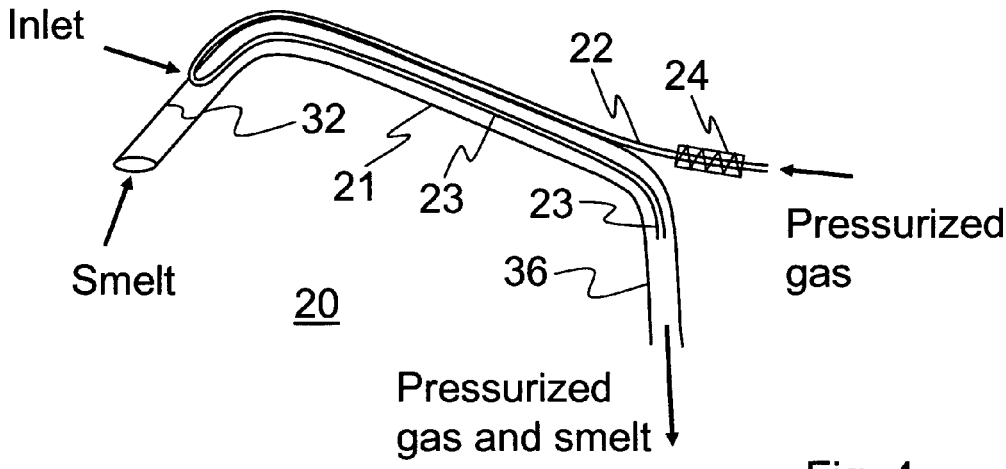
FIG. 4 shows a smelt eductor in accordance with an aspect of the disclosed embodiments.

FIG. 4 shows a third example of a smelt eductor 20 suitable for educting smelt; for a description of the suction pipe 21, refer to FIG. 2. The positioning of the pressurized gas pipe 22 is different from FIG. 2 and, in addition to the preheating provided by means of the positioning of the pressurized gas pipe 22, the pressurized gas can be preheated by means of a separate heating device 24. The pressurized gas pipe 22 may be in direct contact with smelt outside the suction pipe 21. The pressurized gas pipe 22 enters into the suction pipe 21 through an opening drilled into a rectilinear part forming the suction end 32 of the eductor 20, to which opening the pressurized gas pipe 22 is fastened leak-tightly by welding, for example. The discharge end 36 of the eductor is formed by a rectilinear pipe that is fastened through a bend to the rectilinear middle part of the suction pipe. The pressurized gas pipe 22 is fitted into the suction pipe 21 so that the pressurized gas pipe 22 conforms to the form of the suction pipe. Preferably, the pressurized gas pipe 22 is fitted into the suction pipe 21 so that it substantially travels along the entire length of the suction pipe aligned with the center line of the suction pipe. Thus the pressurized gas is discharged in the discharge direction of the eductor 20 generating suction that pulls smelt or water from the furnace. In FIG. 4, the pressurized gas pipe 22 conforms to the form of the suction pipe 21 outside the suction pipe before the pressurized gas pipe enters into the suction pipe 21. Preferably, the pressurized gas pipe 22 is fastened to the outer surface of the rectilinear middle part of the suction pipe 21 and the outer surface of the suction end 32.

Figure 5:
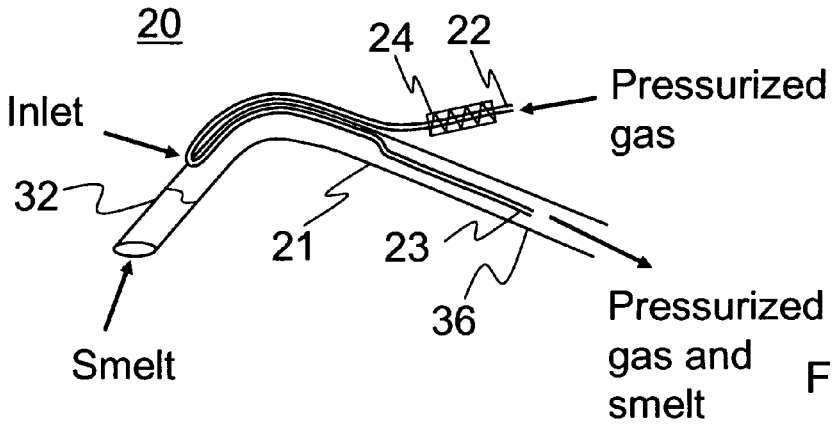
FIG. 5 shows a smelt eductor in accordance with an aspect of the disclosed embodiments.

FIG. 5 shows a fourth example of a smelt eductor 20 suitable for educting smelt, wherein the smelt eductor is short and there is no second bend located on the side of the discharge end 36 as shown in FIGS. 2 and 4. As for the description of the suction pipe, also refer to FIG. 2, as applicable. In addition to the preheating provided by means of the positioning of the pressurized gas pipe 22, the pressurized gas can also be preheated by means of a separate heating device 24. The pressurized gas pipe 22 enters into the suction pipe 21 through an opening drilled into a rectilinear part forming the suction end 32 of the eductor 20, to which opening the pressurized gas pipe 22 is fastened by welding, for example. The discharge end 36 of the eductor is formed by a rectilinear pipe, which is fastened through a bend to the suction end 32. The pressurized gas pipe 22 is fastened within the suction pipe so that the pressurized gas pipe 22 conforms to the form of the suction pipe. In FIG. 5, the pressurized gas pipe 22 is preferably fastened so that is borders on or is close to the inner surface of the suction pipe 21 along the rectilinear part forming the suction end 32 and the initial portion of the rectilinear part forming the discharge end 36, and the pressurized gas pipe 22 is fastened to the center line of the suction pipe 21 in the region of the final part of the discharge end 36. Thus, pressurized gas is discharged in the discharge direction of the eductor 20, generating suction that pulls smelt or water from the furnace. In FIG. 5, the pressurized gas pipe 22 conforms to the form of the suction pipe 21 outside the suction pipe 21 before the pressurized gas pipe enters into the suction pipe 21. Preferably, the pressurized gas pipe is fastened to the outer surface of the discharge end 36 and the suction end 32 of the suction pipe 21.

Pressurized gas may be arranged to be preheated in ways shown in FIGS. 2 to 5 and 7, for example. In certain embodiments, pressurized gas is arranged to be preheated using a separate heating device 24. In certain embodiments, pressurized gas is arranged to be preheated by positioning the pressurized gas pipe 22 to travel along the outer surface of the smelt eductor 20, whereby the pressurized gas is heated due to the impact of the smelt and the furnace. In certain embodiments, pressurized gas is arranged to be preheated by positioning the pressurized gas pipe 22 to travel within the suction pipe 21, whereby the pressurized gas is heated by smelt during its eduction. In certain embodiments, the preheating arrangement of the pressurized gas comprises the positioning of the pressurized gas pipe 22 within the scope of the heating impact of hot smelt and a separate heating device 24 for pressurized gas. In certain embodiments, the separate heating device 24 is a heating resistor. Preferably, the heating resistor 24 is arranged to heat pressurized gas through the pressurized gas pipe 22. In certain embodiments, the heating resistor 24 is arranged to surround the pressurized gas pipe 22 outside the outer surface of the eductor 20. In certain embodiments, the heating device enables raising the temperature of the pressurized gas to 300° C., for example.

Figure 6:
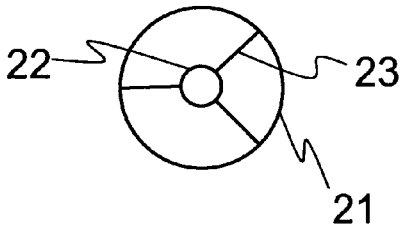
FIG. 6 shows a cross-section of a smelt eductor in accordance with an aspect of the disclosed embodiments.

FIG. 6 shows a cross-section of a smelt eductor 20 in a region where a pressurized gas pipe 22 is installed by means of one or more supports 23 in a desired place in the cross-section of a suction pipe 21, in the case shown in FIG. 6, along the center line of the suction pipe 21. The fastening of the pressurized gas pipe 22 within the suction pipe 21 along the center line of the suction pipe by means of the support or supports 23 is illustrated in FIGS. 3, 4 and 5. In FIG. 4, two supports 23 are used: one at about the middle of the rectilinear middle part of the suction pipe and another at the discharge end of the pressurized gas pipe 22. in FIGS. 3 and 5, one support 23 is used at the discharge end of the pressurized gas pipe 22. The support 23 preferably comprises arms that are fastened, e.g., by welding between the outer surface of the pressurized gas pipe 22 and the inner surface of the suction pipe 21. Preferably, there are three of said arms. The arm 23 can be a prefabricated part, which is fastened in place by welding, for example. The arms of the support 23 are preferably shaped so that they cause minimal hindrance to the flow of the smelt. In certain embodiments, at least part of the pressurized gas pipe 22 is arranged to be aligned with the center line of the suction pipe, preferably to coincide with the center line of the suction pipe 21.

An arrangement where the pressurized gas pipe 22 conforms to the form of the suction pipe achieves preheating of a pressure medium, such as pressurized gas, before the pressure medium is discharged from the discharge end of the pressurized gas pipe 22. Typically, the temperature of the pressurized gas may be about 20° C. before its entry into the pressurized gas pipe 22 and significantly closer to the temperature of the smelt being sucked when it is discharged from the discharge end. Thereby, occurrences of significant local temperature differences at the discharge end 36 of the eductor 20 are decreased.

The pressurized gas pipe (or a pressurized air connection) may be designed and supported so that it simultaneously serves as an installation arm for the eductor, holding which the eductor may be pushed in place. Alternatively, a special installation arm (not shown) may be fitted to the eductor (by welding, for example), holding which the eductor 20 may be installed in a smelt spout opening or another installation opening in a wall of the black liquor boiler.

The pressurized gas required for the eductor 20 may be taken from a low-pressure steam line or pressurized air system (not shown) used at the mill. The pressurized gas pipe 22 is connected to the mill's steam or pressurized gas network with a pressure hose equipped with suitable fittings.

Figure 7:
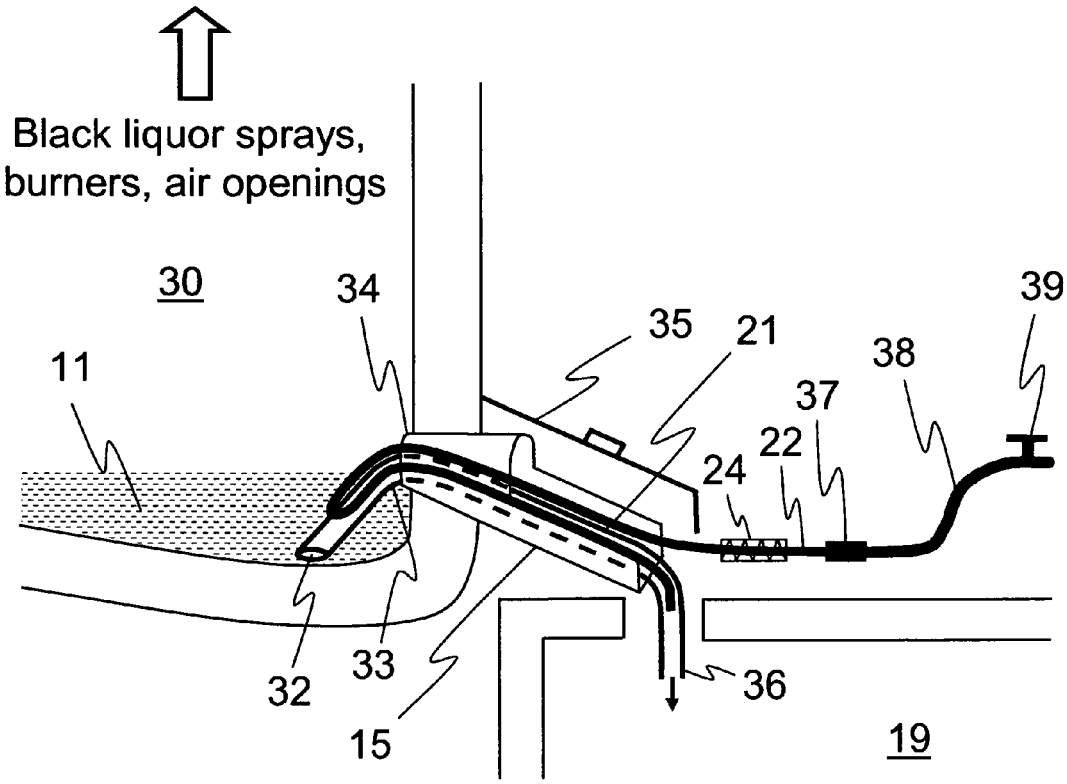
FIG. 7 shows a smelt eductor in accordance with an aspect of the disclosed embodiments installed in place.

FIG. 7 shows a smelt eductor 20 installed in place. The smelt eductor shown in FIG. 4 is used herein as an example. In FIG. 7, pressurized gas is preheated before being discharged from the discharge end of the pressurized gas pipe 22 within the pressurized gas pipe 22, which is positioned within the scope of the heating impact of hot smelt outside and inside the suction pipe 21 and, furthermore, the pressurized gas may be preheated before its discharge from the discharge end of the pressurized gas pipe 22 by using a heating device 24 arranged around the pressurized gas pipe 22.

In the example case, the suction pipe 21 of the eductor is installed in a smelt spout 15, whereby the suction end of the eductor is pushed from the smelt spout opening into the smelt pool 11 on the furnace 30 floor, below the surface of the pool and close to the floor. In one embodiment, the smelt eductor is designed so that it conforms to the form of the smelt spout 15. In another embodiment, the mouth 32 of the suction end is designed so that it is in a substantially horizontal plane in its operating position in order to improve suction. The part of the suction pipe 21 between the bend 33 and the mouth 32 of the suction end is designed so that it reaches the desired location on the furnace floor. In one embodiment, this bent part serves to prevent lateral movement of the eductor and tilting of the eductor to one side as the tip of the bent part tends to fall downward. The pressurized gas connection entering the eductor may also serve to prevent lateral movement. If there is a hood with a hinged cover 35 above the smelt spout 15, it may serve to prevent lateral movement of the smelt eductor. Typically, the hood 35 has the same width as the smelt spout 15. The edges of the hood 35 limit the margin for lateral movement of the pressurized gas connection.

In one embodiment the smelt spout 15 comprises a part that forms a collar 34 in the smelt spout opening in the wall of the furnace 30. In the example case illustrated in FIG. 7, the bent part between the bend and the suction end (or the bend 33) rests on the edge of the smelt spout collar 34 when the smelt eductor is installed in the opening. The part of the suction pipe 21 extending from this point towards the discharge end rests on the remaining part of the smelt spout 15. In other words, the smelt spout 15 forms a support surface which the smelt eductor rests on and which keeps the smelt eductor in place.

In the embodiment shown in FIG. 7, the smelt falls from the opening at the discharge end 36 of the eductor directly into the dissolving tank 19. Alternatively, the eductor may be shorter and/or the bend on the side of discharge end may be omitted (as in FIG. 5). In this case, for example, the smelt may be discharged from the eductor first into the smelt spout 15 and through the smelt spout into the dissolving tank 19.

When the smelt eductor has been installed in place, it is taken into use by connecting the pressurized gas pipe 22 with suitable fittings 37 to a pressurized gas line 38 and opening a valve 39 in the pressurized gas line so that the gas being discharged into the eductor generates the negative pressure used for eduction. The valve 39 of the pressurized gas line may be located far from the eductor, whereby the use of the eductor does not require working in its immediate vicinity.

In certain embodiments, the pressure of the pressure medium in the pressurized gas line 39 is about 10 bar.

In some cases, hot steam is readily available in the vicinity of the black liquor recovery boiler. In certain embodiments, the pressure medium is steam; in certain embodiments, the temperature of the steam is about 200° C.

In alternative embodiments the emptying of the floor of the black liquor recovery boiler is implemented in ways that deviate from the above. For example, instead of the smelt spouts, the eductor may be installed in openings made in the walls of the furnace particularly for the purpose of emptying the floor, located above the surface of the smelt pool close to the location where the smelt pool on the floor is at its deepest. Thereby the eductor will more easily reach the deepest location of the smelt pool and the floor can be emptied of smelt practically completely.

Besides for removing smelt, the smelt eductor described above is also suitable for removing wash water collected on the furnace floor when the boiler is water washed. When removing wash water, the eductor is, in principle, installed in the same way as when removing smelt. Instead of the smelt pool, the suction end is pushed into a water pool formed in the boiler.

The shape and size of the suction pipe and the pressurized gas pipe of the eductor and the pressure of the pressurized gas may be altered in order to adapt the power of the eductor to each particular need and existing structures. In addition, instead of connecting the eductor directly to the smelt spout or dissolving tank, depending on the purpose of use, the eductor may be connected to a pipe extension, through which the smelt flows to the dissolving tank or another collection system.

Alternative materials for the eductor may include, among other materials, various steels that can resist high temperatures as well as erosion and corrosion caused by the smelt better than acid-proof steel.

In a further embodiment, instead of the pressure medium pipe solutions presented above by way of example, a special pressure medium channel solution may be used for transferring the pressure medium within the suction device. In some of these embodiments, another pipe, i.e. an outer pipe, surrounds the suction pipe (21) presented above, whereby a hollow space, i.e. a pressure medium channel, is provided between the outer surface of the suction pipe (21) and the inner surface of the outer pipe. The pressure medium channel may be aligned with the longitudinal direction of the suction pipe (21), whereby it extends in the space between the outer surface of the suction pipe (21) and the inner surface of the outer pipe in the longitudinal direction of the suction pipe (21). Alternatively, instead of an outer pipe, another closed structure may be used to form a corresponding pressure medium channel between the outer surface of the suction pipe (21) and the inner surface of the structure. The pressure medium may be conducted into the pressure medium channel closer to the suction end of the suction device and discharged into the suction pipe (21) closer to the discharge end of the suction device at the discharge end of the channel, which thus forms an outlet of the pressure medium channel within the suction pipe (21). In practice, an inlet may be arranged from the pressure medium channel into the suction pipe (21). In an embodiment, the flow direction of the pressure medium within the suction pipe (21) is arranged to coincide with the discharge direction of the suction pipe (or suction device) by means of a longer or shorter stretch of pipe or similar in connection with the inlet, whereby the pressure medium is made to discharge at its outlet into the suction pipe (21) in the discharge direction of the suction pipe. The preheating of the pressure medium operates in the same way as presented above, i.e., due to the impact of hot smelt or using a separate heat source.

The above description provides non-limiting examples of certain exemplary embodiments of the invention. However, it is apparent to persons skilled in the art that the invention is not limited to the details presented; rather, the aspects of the disclosed embodiments may also be implemented in other equivalent ways. The methods and the smelt eductor described above may also be used for sucking smelt in other possible industrial processes where smelt is generated. For the purposes of this document, the terms "comprise" and "include" are open-ended and are not intended to be limiting.

Some characteristics of the embodiments disclosed may be utilized without using the other characteristics. The above description, as such, should be regarded as a descriptive presentation of the principles of the invention and not as limiting the invention. Therefore, the scope of the invention is only limited by the appended claims.

What is claimed is:

1. A method for emptying the floor of a black liquor recovery boiler when the boiler is being shut down, the method comprising:

generating negative pressure suction with a suction device by arranging discharge of a pressure medium from an outlet within the suction device in the discharge direction of the suction device, and sucking smelt from the black liquor recovery boiler with the suction device through an opening in a wall of the black liquor recovery boiler by the generated negative pressure suction, the suction device comprising a suction pipe with a form; and preheating the pressure medium by the smelt in a pressure medium pipe that extends into an interior of the black liquor recovery boiler and conforms to the form of the suction pipe before it is discharged from the outlet.

2. A method as claimed in claim 1, wherein the pressure medium is heated with the aid of hot smelt.

3. A method as claimed in claim 1, wherein the pressure medium is conducted within the pressure medium pipe inside the suction device so as to heat the pressure medium before it is discharged from the outlet.

4. The method as claimed in claim 1, wherein the pressure medium comprises pressurized gas or pressurized steam.

* * * * *